US007513241B2

(12) United States Patent
Ganser

(10) Patent No.: US 7,513,241 B2
(45) Date of Patent: Apr. 7, 2009

(54) FUEL INJECTION VALVE WITH PRESSURE GAIN

(75) Inventor: Marco Ganser, Oberageri (CH)

(73) Assignee: Ganser-Hydromag AG (CH)

( * ) Notice: Subject to any disclaimer, the term of this patent is extended or adjusted under 35 U.S.C. 154(b) by 0 days.

(21) Appl. No.: 11/667,917

(22) PCT Filed: Nov. 8, 2005

(86) PCT No.: PCT/CH2005/000656

§ 371 (c)(1),
(2), (4) Date: May 17, 2007

(87) PCT Pub. No.: WO2006/058444

PCT Pub. Date: Jun. 8, 2006

(65) Prior Publication Data

US 2008/0115765 A1 May 22, 2008

(30) Foreign Application Priority Data

Dec. 3, 2004 (CH) ..... 2006/04

(51) Int. Cl.
*F02M 59/46* (2006.01)
*F02M 41/16* (2006.01)

(52) U.S. Cl. ..... 123/467; 239/96

(58) Field of Classification Search ..... 123/446, 123/447, 467; 239/88–96
See application file for complete search history.

(56) References Cited

U.S. PATENT DOCUMENTS 3,771,760 A * 11/1973 Sheldon et al. ..... 251/75
4,550,744 A 11/1985 Igashira et al.
4,834,141 A * 5/1989 Frisch ..... 137/625.66
4,941,447 A * 7/1990 Mannhardt ..... 123/455
5,004,162 A * 4/1991 Stettner et al. ..... 239/585.1
5,054,691 A * 10/1991 Huang et al. ..... 239/585.3

(Continued)

FOREIGN PATENT DOCUMENTS

DE 199 39 450 3/2001

(Continued)

OTHER PUBLICATIONS

PCT/CH2005/000656 International Search Report, Feb. 3, 2006.

(Continued)

*Primary Examiner*—Thomas N Moulis
(74) *Attorney, Agent, or Firm*—Hershkovitz & Associates, LLC; Abraham Hershkovitz

(57) ABSTRACT

The invention relates to a fuel injection valve for intermittent fuel injection into the combustion chamber of internal combustion engines. A needle-shaped injection valve member (34) is arranged in the high-pressure fuel chamber (30) adjacent to the injection valve seat (32), said injection valve member co-operating with the injection valve seat (32) and defining, in a piston-type manner, the cylinder chamber (36) which is connected to the high-pressure inlet (26). The booster piston (28) is controlled by means of the control valve (34) embodied as a flat seat valve, increasing the pressure of the fuel in the high-pressure fuel chamber (30) for an injection, and thus lifting the injection valve member from the injection valve seat. In this way, the injection is carried out with increased pressure.

21 Claims, 7 Drawing Sheets

U.S. PATENT DOCUMENTS

Figure 1:
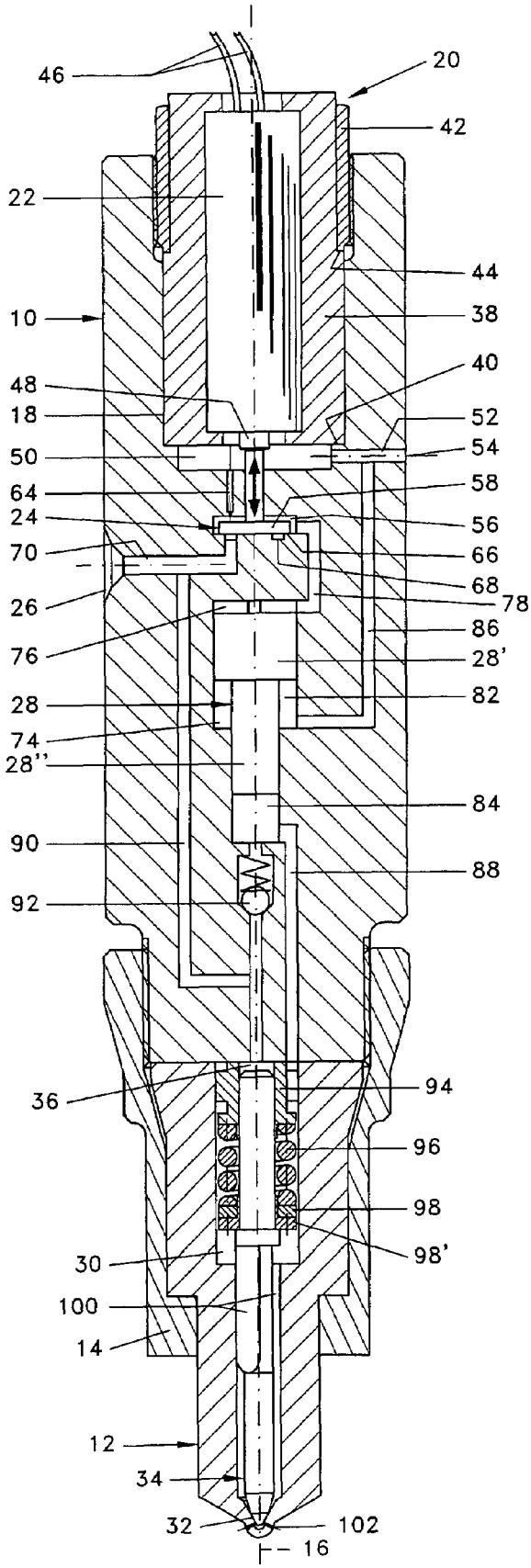

| | | | | | |
|---|---|---|---|---|---|
| 5,372,313 | A | * | 12/1994 | Chabon et al. | 239/585.3 |
| 5,407,131 | A | * | 4/1995 | Maley et al. | 239/90 |
| 5,463,996 | A | | 11/1995 | Maley et al. | |
| 5,494,219 | A | * | 2/1996 | Maley et al. | 239/88 |
| 5,524,825 | A | * | 6/1996 | Ueda | 239/88 |
| 5,605,289 | A | * | 2/1997 | Maley et al. | 239/585.1 |
| 5,669,355 | A | | 9/1997 | Gibson et al. | |
| 5,673,669 | A | | 10/1997 | Maley et al. | |
| 5,687,693 | A | | 11/1997 | Chen et al. | |
| 5,697,342 | A | | 12/1997 | Anderson et al. | |
| 5,738,075 | A | | 4/1998 | Chen et al. | |
| 5,826,562 | A | | 10/1998 | Chen et al. | |
| 5,961,052 | A | * | 10/1999 | Coldren et al. | 239/585.1 |
| 6,021,963 | A | * | 2/2000 | Coldren et al. | 239/585.1 |
| 6,065,450 | A | | 5/2000 | Chen et al. | |
| 6,082,332 | A | | 7/2000 | Hefler et al. | |
| 6,655,654 | B1 | * | 12/2003 | Cotton et al. | 251/129.06 |
| 7,150,444 | B2 | * | 12/2006 | Ohmi et al. | 251/118 |
| 7,182,070 | B2 | * | 2/2007 | Magel | 123/496 |
| 7,387,110 | B2 | * | 6/2008 | Magel | 123/498 |
| 2002/0148444 | A1 | | 10/2002 | Hefler et al. | |
| 2004/0144366 | A1 | * | 7/2004 | Grabandt | 123/446 |
| 2004/0149265 | A1 | | 8/2004 | Magel et al. | |
| 2004/0237930 | A1 | * | 12/2004 | Kawamura et al. | 123/299 |
| 2005/0077378 | A1 | * | 4/2005 | Kropp et al. | 239/88 |
| 2005/0098652 | A1 | * | 5/2005 | Kuroyanagi et al. | 239/102.2 |
| 2005/0224598 | A1 | * | 10/2005 | Potz et al. | 239/88 |
| 2005/0252490 | A1 | * | 11/2005 | Magel | 123/446 |
| 2005/0263133 | A1 | * | 12/2005 | Magel | 123/446 |
| 2006/0202140 | A1 | * | 9/2006 | Magel | 251/30.01 |
| 2006/0243252 | A1 | * | 11/2006 | Eisenmenger et al. | 123/447 |
| 2007/0057096 | A1 | * | 3/2007 | Steinruck et al. | 239/585.1 |
| 2007/0221177 | A1 | * | 9/2007 | Magel | 123/472 |

FOREIGN PATENT DOCUMENTS

| | | |
|---|---|---|
| DE | 199 39 452 | 3/2001 |
| DE | 101 46 532 | 4/2003 |
| DE | 102 50 130 | 3/2004 |

OTHER PUBLICATIONS

PCT/ISA/201 EP Search Report for CH 20062004, Mar. 21, 2005.

* cited by examiner

FUEL INJECTION VALVE WITH PRESSURE GAIN

The present invention relates to a fuel injection valve for intermittent fuel injection into the combustion chamber of an internal combustion engine according to patent claim 1.

DE-A-10250130 discloses a fuel injection valve in which a solenoid actuator controls a 3/2 or 6/3-way valve. This control valve serves, according to the activation of the actuator, to control a booster piston in the form of a differential piston and the delivery of fuel into a high-pressure fuel chamber adjoining an injection valve seat, in such a way that injection is pressure-controlled or lift-controlled. In such control valves the control valve member in each case has to cover a large distance in order to travel from one operating position into another operating position.

This distance is typically several tenths of a millimeter. Furthermore, multiple injection by means of such control valves is very complex and the design construction of the fuel injection valve is extremely costly.

An object of the present invention is to create a fuel injection valve with pressure gain, the control valve of which requires only a very small lift on the part of the control valve member.

This object is achieved by a fuel injection valve having the features of patent claim 1.

According to the invention the control valve is embodied as a flat seat valve. A characteristic of flat seat valves is that they expose large through-flow cross sections for a very small lift. The control valve member of a fuel injection valve according to the invention typically only requires a lift of about 2/100 to 10/100 mm. The control valve member can therefore also be controlled by means of a piezoelectric actuator. Multiple injections are furthermore readily feasible, irrespective of whether the actuators used are piezoelectric actuators or very rapid solenoid actuators.

Preferred embodiments of the fuel injection valve according to the invention are specified in the dependent patent claims.

Figure 2:
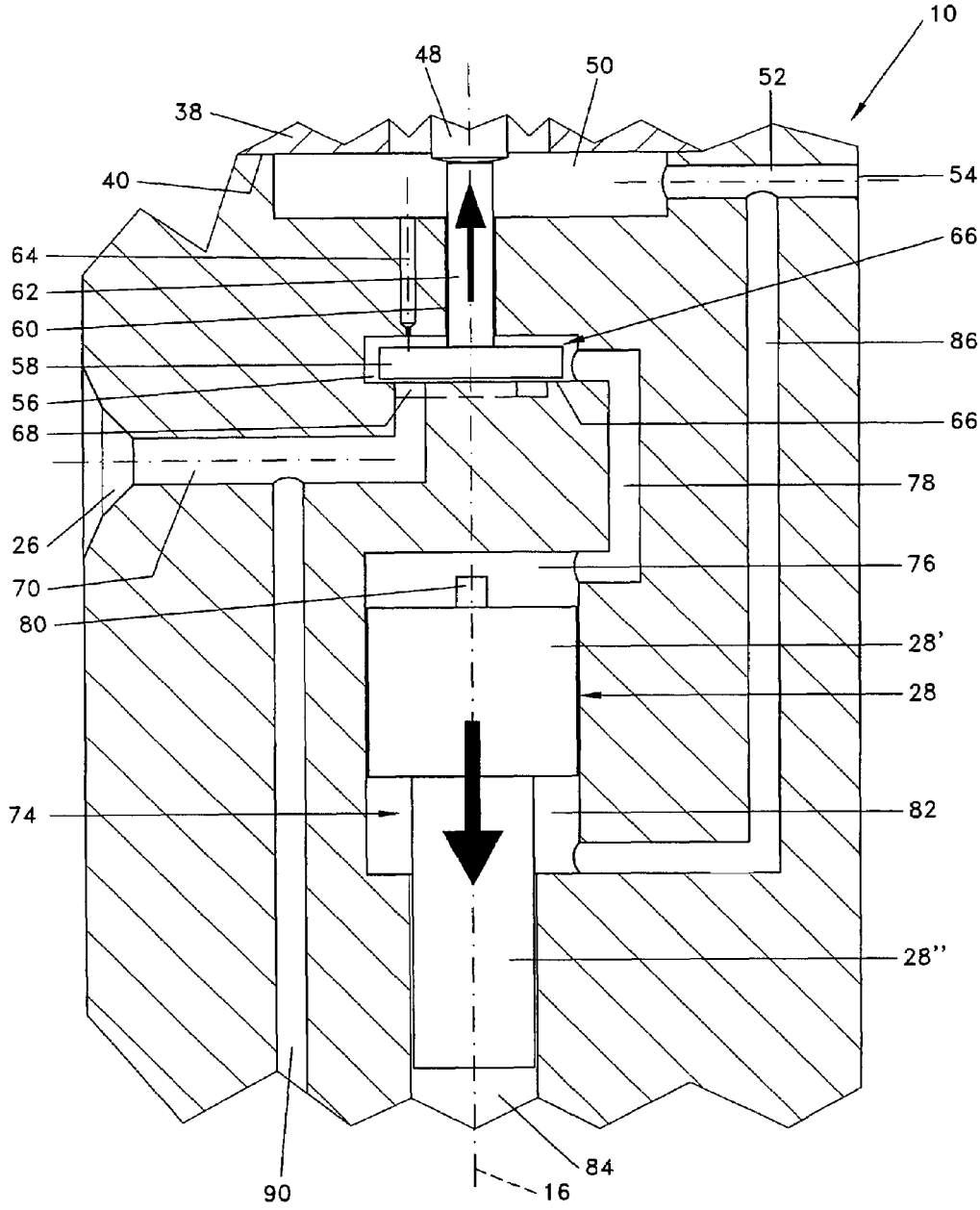
Figure 3:
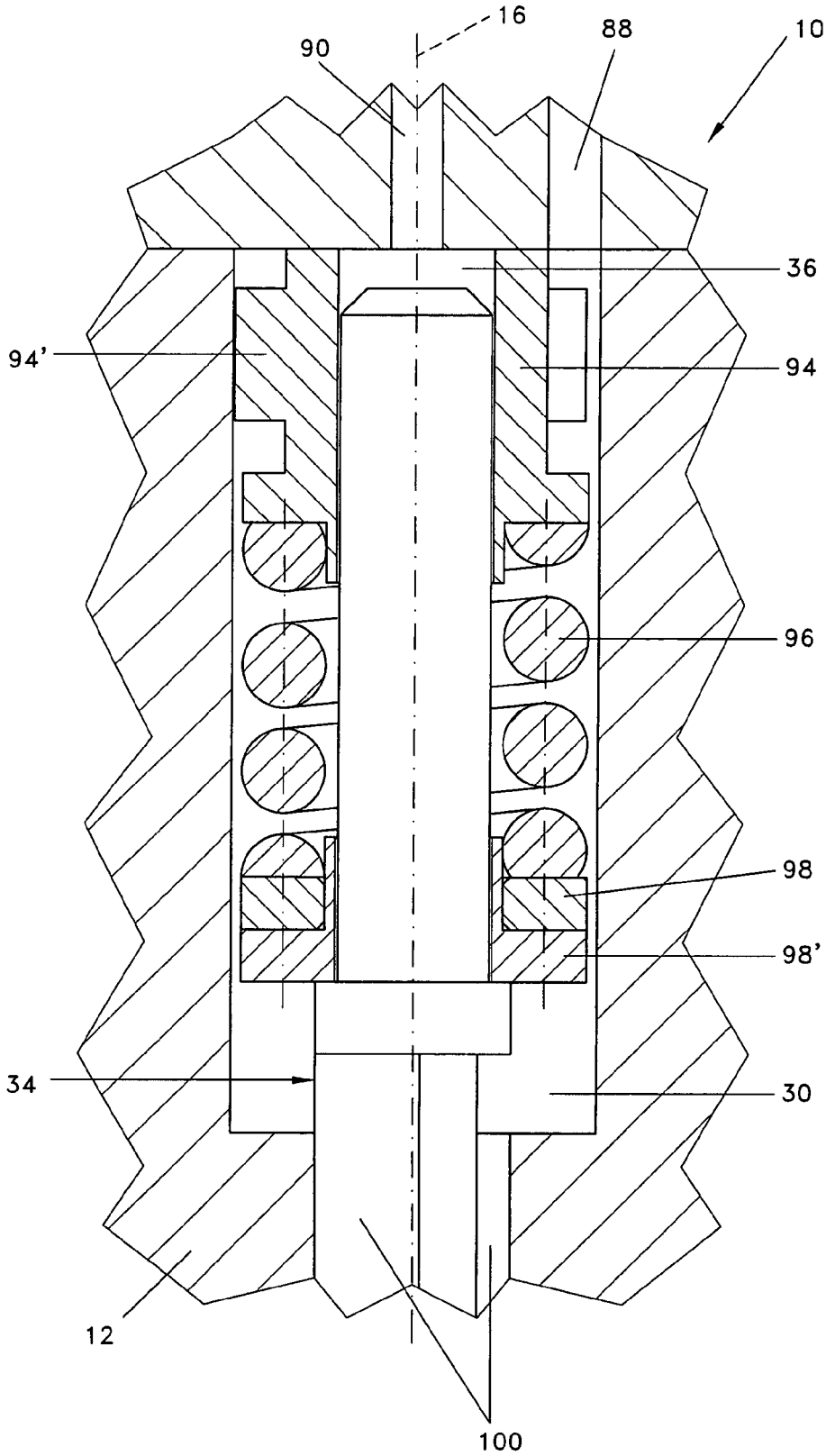
Figure 4:
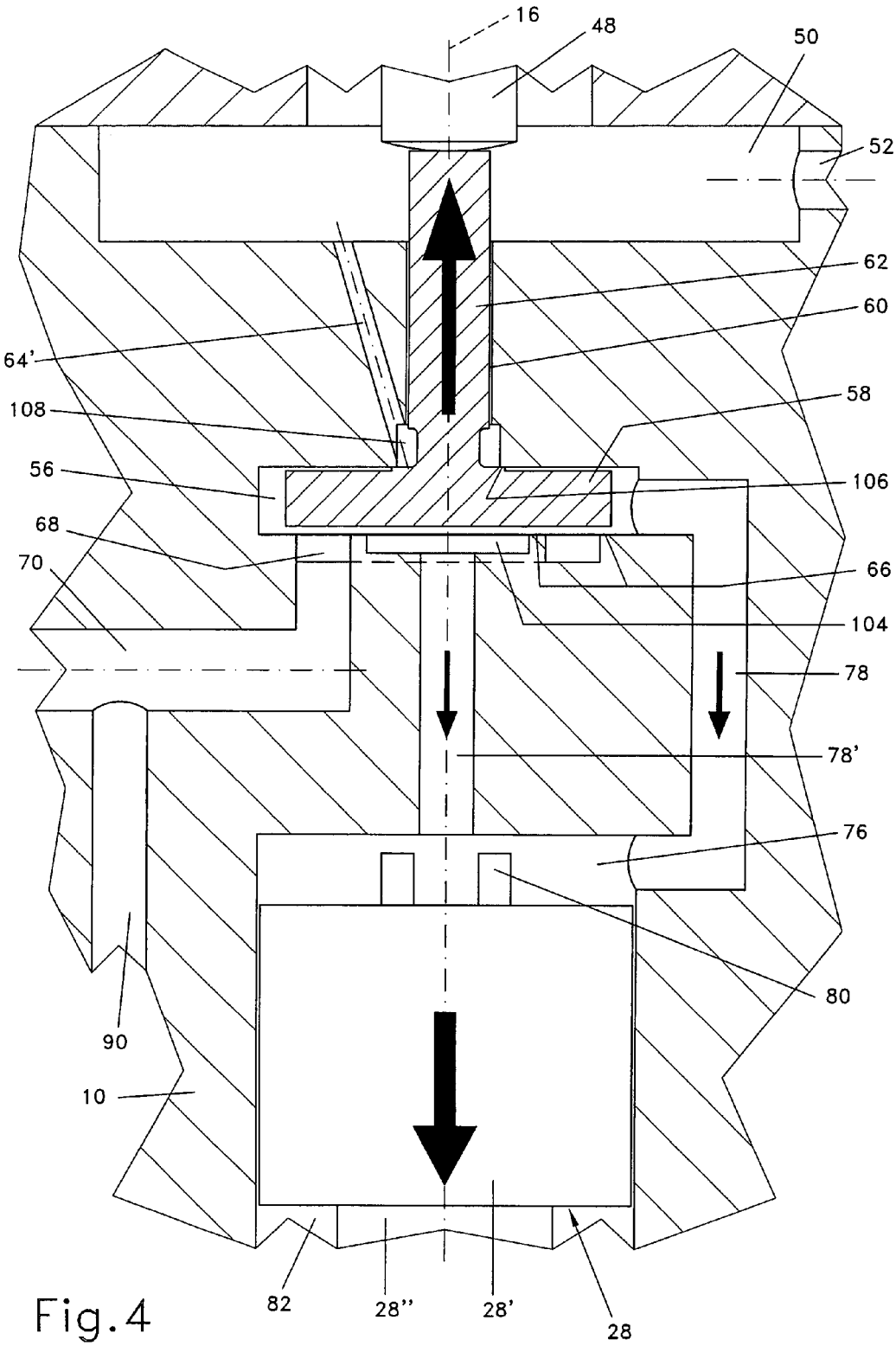
Figure 5:
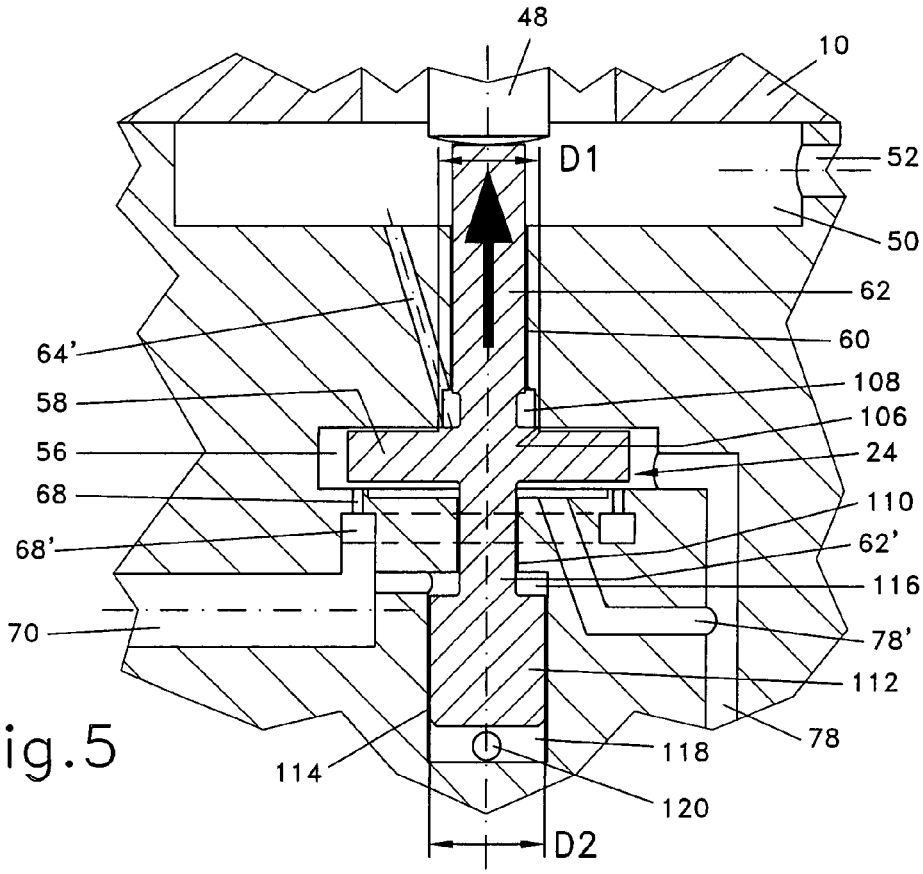
Figure 6:
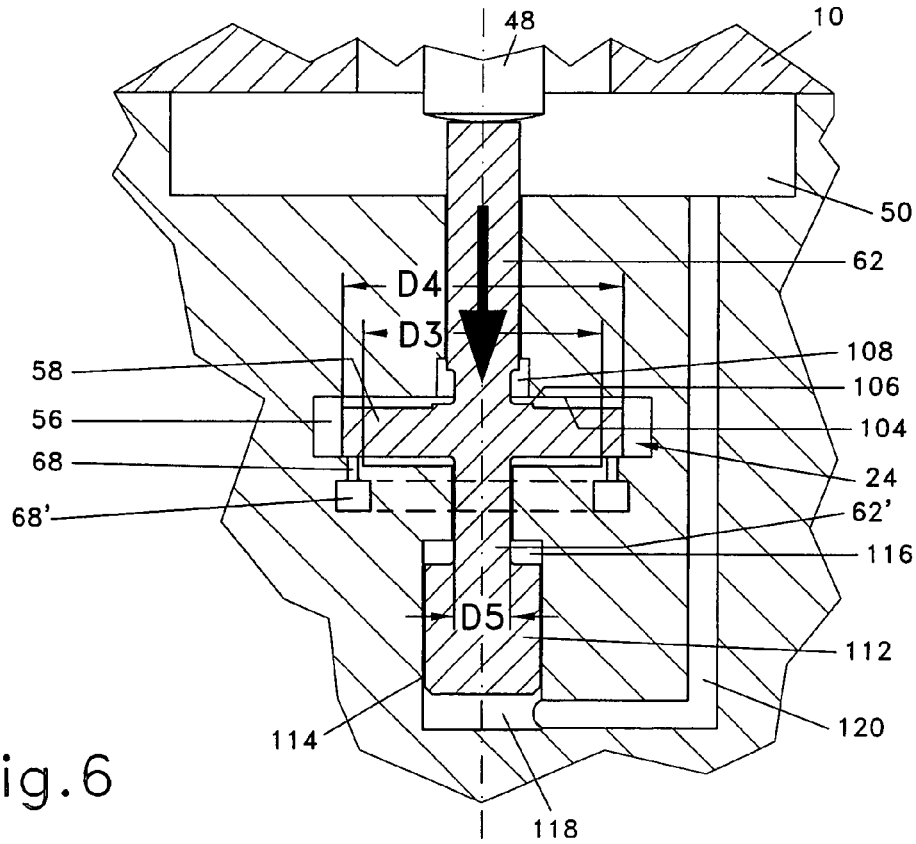
Figure 7:
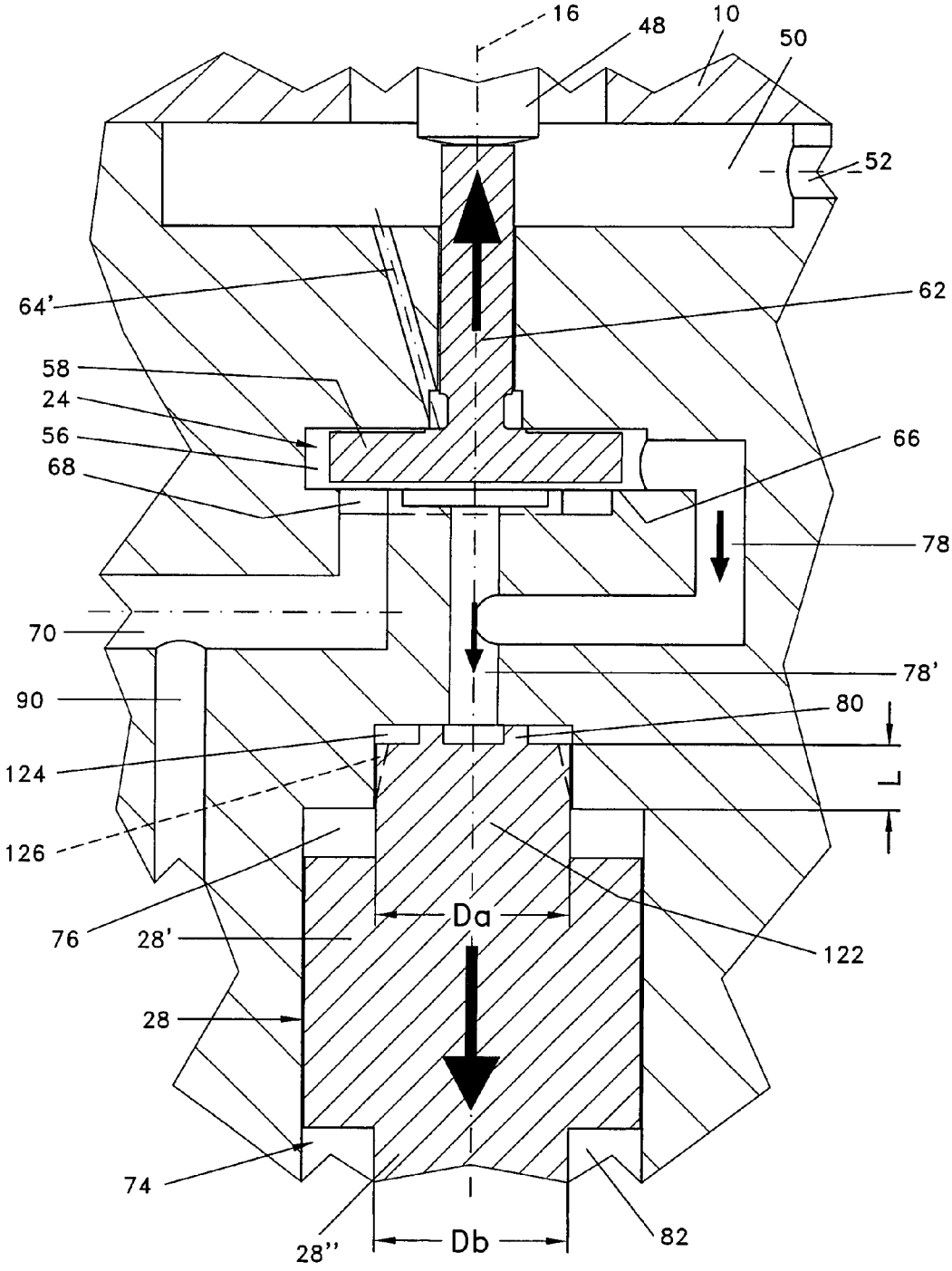
Figure 8:
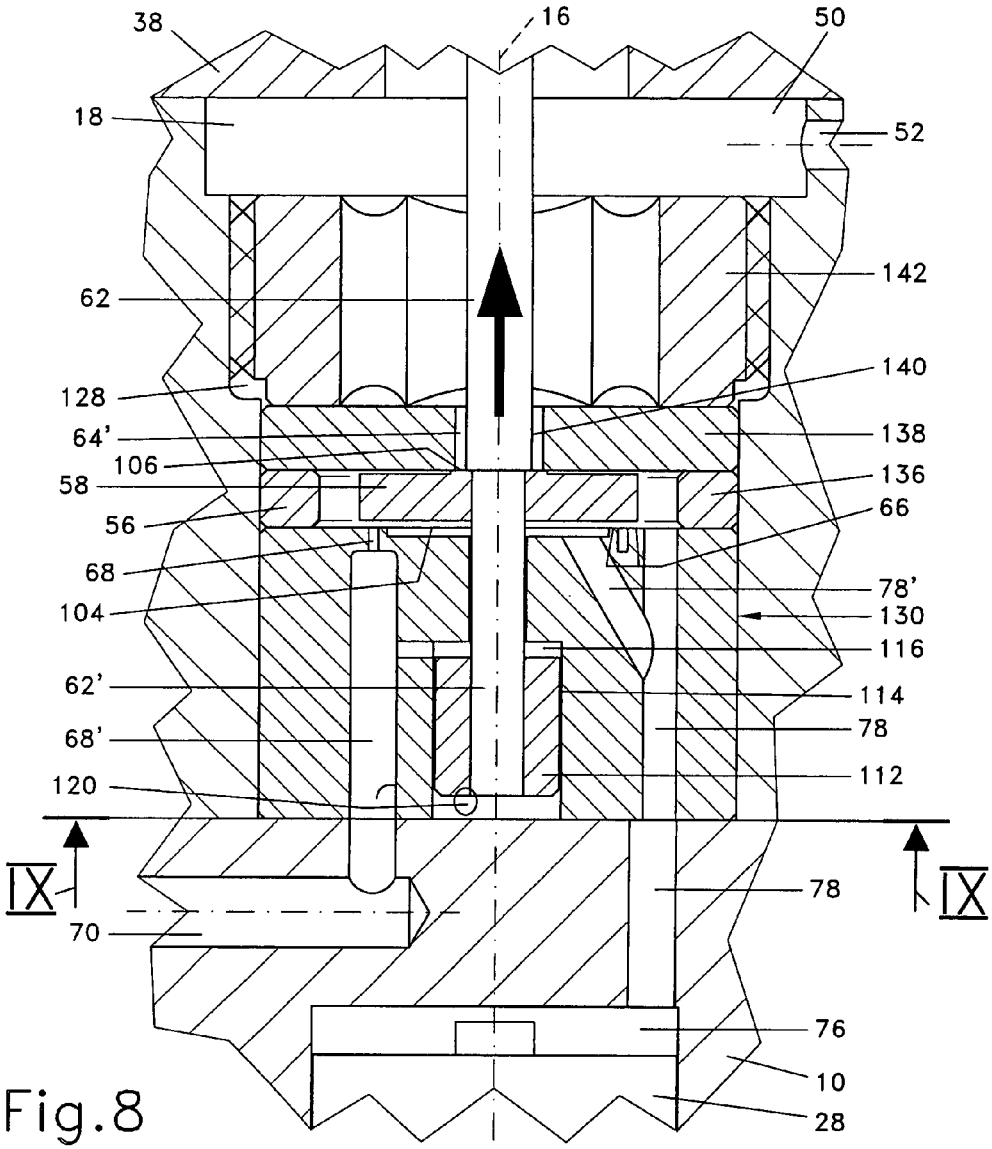
Figure 9:
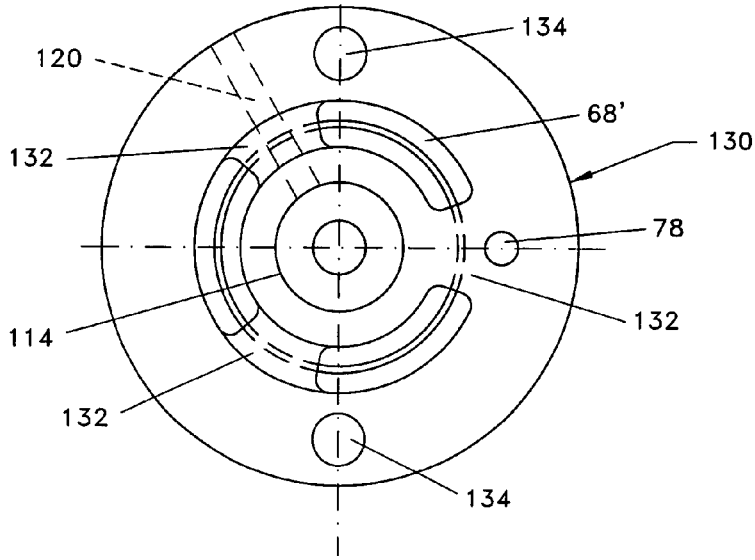

The invention will be described in more detail with reference to exemplary embodiments represented in the purely schematic drawing, in which:

FIG. 1 shows a longitudinal section through a first embodiment of a fuel injection valve according to the invention;

FIG. 2 likewise shows a longitudinal section through a part of the fuel injection valve shown in FIG. 1, having a control valve and a booster piston;

FIG. 3 likewise shows a longitudinal section through a part of the fuel injection valve shown in FIG. 1, having an injection valve member which is loaded by means of a closing spring and which in the manner of a piston defines a cylinder chamber;

FIG. 4 in the same representation as in FIG. 2, shows a second embodiment of a fuel injection valve according to the invention;

FIG. 5 in the same representation as in FIGS. 2 and 4, shows a third embodiment of a fuel injection valve according to the invention, having pressure compensation for the control valve member, which is shown in the open position;

FIG. 6 shows the embodiment shown in FIG. 5 in a longitudinal section, which runs at right angles to the longitudinal section shown in FIG. 5, the control valve member being in the closed position;

FIG. 7 in the same representation as in FIG. 2, shows a fourth embodiment of an injection valve according to the invention, having a stepped booster piston;

FIG. 8 in the same representation as in FIGS. 5 and 6, shows a further embodiment similar to the embodiment shown there, having a different mechanical construction;

FIG. 9 shows a control valve seat body of the embodiment shown in FIG. 8, in a cross section along the line IX-IX in FIG. 8.

A fuel injection valve shown in FIG. 1 is intended for the intermittent injection of fuel into a commonly known combustion chamber of an internal combustion engine. It has a substantially circular cylindrical, stepped housing 10, on the end face of which—on that side having the smaller outside diameter—a valve seat element 12 is fixed in a known manner by means of a union nut 14. In the present example, the axis of the housing 10, of the valve seat element 12 and the union nut 14 coincide and is denoted by 16. The axes of the housing, of the valve seat element and of the union nut could also differ or run at an angle to one another.

An actuator arrangement 20 is arranged in a recess 18 in an end area of the housing 10 remote from the valve seat element 12. A piezoelectric actuator 22 of the actuator arrangement 20 is intended to activate a control valve 24. In the open position, this valve connects a control pressure inlet 26 for the fuel on the housing 10 to the control pressure side of a booster piston 28 embodied as a differential piston. The high-pressure side of the booster piston 28 is connected to a high-pressure fuel chamber 30, which is arranged in the valve seat element 12 and which adjoins a conical injection valve seat 32 formed on the valve seat element 12. A needle-like injection valve member 34, which on the one hand is intended to interact with the injection valve seat 32 and on the other in the manner of a piston defines a cylinder chamber 36 connected to the control pressure inlet 26, is arranged in the high-pressure fuel chamber 30 concentrically with the axis 16 and longitudinally displaceable in the direction of this axis 16. The control pressure—or also the feed pressure—is approximately 200-1600 bar.

The control valve 24, the booster piston 28 and all necessary connecting passages are arranged in the housing 10 or formed on the latter. For greater clarity, the housing 10 is shown in one piece, although it may be composed of multiple parts in order to facilitate the formation of the necessary recesses and connecting passages during manufacture.

The piezoelectric actuator 22 is accommodated in an actuator housing 38, which on the one hand bears against a shoulder 40 of the recess 18 on the housing 10 and on the other is held in contact with the shoulder 40 by means of a sleeve-shaped fastening screw 42, which is threaded into the housing 10 and rests against a support shoulder 44 of the actuator housing 38. Electrical control leads, by way of which the actuator 22 is activated in a known manner from a control, are denoted by 46. The actuator 22 has an actuator stem 48, which on energizing or de-energizing of the actuator 22 is moved in the direction of the axis 16 by a lift of approximately 0.02-0.1 mm in one or the other direction.

Adjacent to the actuator arrangement 20, the recess 18 has a low-pressure chamber 50, which is connected by way of a low-pressure passage 52 running radially through the housing 10 to a low-pressure outlet connection 54 on the housing 10, from which fuel lost due to leakage or the control is led into a fuel storage tank.

The control valve 24 and the pressure boost device with the booster piston 28 will be described in more detail with reference to FIG. 2. A circular cylindrical control valve chamber 56, in which a disk-shaped control valve member 58, moveable in the direction of the axis 16, is accommodated, is recessed into the housing 10 concentrically with the axis 16. Running from the control valve chamber 56 to the low-pressure chamber 50 is a guide passage 60, which has an operating stem 62 passing through it with a tight sliding fit, the latter bearing on the control valve member 58 on the one hand and the free end of the actuator stem 48 on the other. The control valve chamber 56 is furthermore connected to the low-pressure chamber 50 via a restriction duct 64.

On the side of the control valve member 58 remote from the operating stem 62, the control valve chamber 56 is bounded by a plane control valve seat 66 formed on the housing 10. Interacting with said seat is the disk-shaped control valve member 58, which on the side facing the control valve seat 66 is likewise formed with a high-precision plane face. In FIG. 2 the control valve member 58 is in an open position separated from the control valve seat 66, whereas in FIG. 1 it is shown in its closed position bearing against the control valve seat 66.

In the area of the control valve seat 66, an annular inlet groove 68, which runs around the axis 16 and which is open in the direction toward the control valve chamber 56 and closed by the control valve member 58 when the control valve 24 is closed, is formed in the housing 10. The inlet groove 24 is flow-connected to the control pressure inlet 26 via a control pressure duct 70 in the housing 10. It is furthermore designed with the largest possible radial outside diameter, so that when the control valve 24 opens a large flow cross section is very rapidly exposed.

A circular cylindrical piston guide chamber 74, in which a control pressure-side piston part 28' of the booster piston 28 is accommodated and is guided so that it is capable of reciprocating with a tight sliding fit in the direction of the axis 16, is formed in the housing 10 concentrically with the axis 16. The piston guide chamber 74 and the control pressure-side piston part 28' define a piston drive chamber 76, which is permanently flow-connected via a connecting duct 78 formed in the housing 10 to the control valve chamber 56 and hence through the restriction duct 64 to the low-pressure outlet 54. The clear cross sections of the control pressure duct 70 and the connecting duct 78 are much larger than the narrowest cross section of the restriction duct 64. Furthermore, on its control pressure-side end face the booster piston 28 has a projecting stop lug 88, which prevents the booster piston 28 from being able to bear against the housing 10 with its nearside end face.

On the other side a piston part 28", of smaller cross section but likewise of circular cylindrical shape, leads from the piston part 28' and passes through a low-pressure side part 82 of the piston guide chamber 74, and is guided in a tight sliding fit against the wall of a cylindrical recess extending away from the low-pressure side part 82. With its high-pressure side end the piston part 28" defines a piston output chamber 84. The low-pressure side part 82 of the piston guide chamber 74 is permanently connected to the low-pressure outlet 54 via a low-pressure duct 86 leading into the low-pressure passage 52.

From the piston output chamber 84—see FIG. 1—a high-pressure line 88 formed in the housing 10 leads to the end face of the housing 10, where it opens into the high-pressure fuel chamber 30. Branching off from the control pressure duct 70 is a control pressure branch line 90, which on the one hand opens into the piston output chamber 84 via a non-return valve 92, and on the other opens into the cylinder chamber 36 at the end face of the housing 10. The non-return valve 92 in the form of a spring-loaded ball valve allows fuel to flow from the control pressure inlet 26 into the piston output chamber 84, but prevents fuel flowing out from the piston output chamber 84 into the control pressure branch line 90.

As can be seen from FIG. 1 and in particular from FIG. 3, the high-pressure fuel chamber 30 formed by a recess in the valve seat element 12 is of circular cylindrical shape stepped in relation to the axis 16 and is defined on one side by the injection valve seat 32 and on the other by the end face of the housing 10. A sleeve-like needle guide element 94, which on the one hand is centered and supported on the valve seat element 12 by three ribs 94' projecting radially outwards, and radially inside which, on the other hand, the nearside end area of the injection valve member 34 is guided with a tight sliding fit, is arranged in the high-pressure fuel chamber 30. Alternatively, the ribs 94' can also be omitted (guiding of the needle guide element 94 would be assumed by ribs 100, see below). The needle guide element 94 peripherally defines the cylinder chamber 36 and under the force of a closing spring 96 bears tightly against the end face of the housing 10. The closing spring 96 is braced against the free end of the needle guide element 94 on the one hand, and by way of a washer 98 and a support element 98' in a known manner against the injection valve member 34 on the other. The closing spring 96 presses the fuel injection valve member 34 toward the injection valve seat 32. Between the valve seat element 12 and the needle guide element 94, the closing spring 96 and the injection valve member 34 a large flow cross section remains open for the fuel.

The injection valve member 34 has three radially projecting guide ribs 100, by means of which it is guided so that it is axially displaceable against the valve seat element 12 in the area of that part of the high-pressure fuel chamber 30 having a narrower cross section. A larger flow cross section exists in the area between the three guide ribs 100, so that fuel can flow unimpeded to the injection valve seat 32.

For the sake of completeness, it should be mentioned that downstream of the injection valve seat, nozzle passages 102 are recessed into the valve seat element 12, through which fuel is injected into the combustion chamber under very high pressure during the injection process.

In the embodiment shown in FIGS. 1 to 3 the control valve 34 embodied as a flat seat valve functions as a 2/2-way valve.

In the description of the embodiment of the fuel injection valve according to the invention shown in FIG. 4, the same reference numerals as those used in connection with the embodiment shown in FIGS. 1-3 are used for identical or identically functioning parts. It is furthermore proposed to examine below only those aspects which differ from the embodiment already described.

A circular cylindrical recess, which forms an outlet opening 104 encompassed at a distance by the inlet groove 68, is formed on the housing 10, concentrically with the axis 16, in the area of the control valve seat 66. This opening is flow-connected to the piston drive chamber 76 via a further connecting duct 78'. The parallel connection of the connecting duct 78 and the further connecting duct 78' means that between the control valve 24 and the piston drive chamber 76 the flow cross section at the control valve seat 66 is virtually twice that in the embodiment according to FIGS. 1-3, so that the lift of the control valve member 58 can be reduced and/or the fuel injection quantity per injection can be increased.

The injection valve member 34 is again of plate or disk-shaped design, but is now firmly connected to the operating stem 62, and is preferably integrally formed with the latter. In the closed position, the control valve member 58 bears tightly against an annular sealing face of the control valve seat 66, adjoining and radially outside the inlet groove 68, on the one hand, and against a further, likewise annular sealing face of the control valve seat 66, arranged between the inlet groove 68 and the outlet opening 104, on the other. In the open position of the control valve 34 shown in FIG. 4, the control valve member 58 opens the connection from the inlet groove 68 to the connecting duct 78 and the further connecting duct 78'.

On the side remote from the control valve seat 66, the control valve member 58 has an annular sealing shoulder 106, which protrudes radially in relation to the adjoining operating stem 62 and axially in relation to the remaining part of the control valve member 58. In the open position of the control valve 24 the sealing shoulder 106 bears tightly against the housing 10. In its end area facing the control valve chamber 56, the guide passage 60, in which the operating stem 62 is guided with a sliding fit, is widened to a peripheral relief groove 108, which by way of a relief duct 64' is permanently—and without restriction—connected to the low-pressure chamber 50 and hence to the low-pressure outlet 54. When the control valve 24 closes, fuel can thereby flow out of the control valve chamber 56 and hence to the piston drive chamber 76 more rapidly than in the embodiment shown in FIGS. 1-3, which leads to a more rapid termination of the injection sequence when the control valve 24 closes. This permits multiple injections at very brief time intervals.

In the two embodiments of the fuel injection valve shown in FIGS. 1-4, the actuator 22 must close the control valve 24 with great force and then keep it in the closed position. Given the pressures per unit area typical for fuel injection valves, such large forces can generally be exerted only by piezoelectric actuators. FIGS. 5 and 6 show an embodiment of a fuel injection valve according to the invention, in which this problem is eliminated and which also allows the control valve 24 to be controlled by means of a solenoid actuator 22, this being achieved through at least partial compensation of the forces acting on the control valve member 58 due to the pressure differentials.

The embodiment shown in FIGS. 5 and 6 is similar to the embodiment shown in FIG. 4. Only the differences will be examined below.

On the disk-like control valve member 58, a stem 62' which is guided in a tight sliding fit in a stem passage 110 in the housing 10 and carries a compensating piston 112 in its free end area, is arranged and preferably formed in one piece on the side remote from the operating stem 62. The compensating piston 112 is likewise guided in a tight sliding fit in a cylinder recess 114. On the side of the compensating piston 112 facing the control valve member 58, the cylinder recess 114 and the compensating piston 112 define a compensating pressure chamber 116, which is flow-connected to the control pressure duct 70 and hence to the control pressure inlet 26. A compensating low-pressure chamber 118, likewise defined by the cylinder recess 114 and the compensating piston 112, on the side of the compensating piston 112 remote from the control valve member 58, is flow-connected to the low-pressure chamber 50 by way of a compensating low-pressure passage 120, as can be seen in particular from FIG. 6.

The peripheral inlet groove 68 is furthermore narrower, that is to say of a more slot-like design, in its radial width compared to the embodiments shown in FIGS. 1-4, thereby reducing the force acting on the control valve member 58 when the control valve 24 is closed. The inlet groove 68 is fed via an annular duct 68' of larger cross section, however, which communicates with the control pressure duct 70.

Since the stem 62', the compensating pressure chamber 116 and the compensating piston 112 are arranged concentrically with the axis 16, the further connecting duct 78' opens offset radially outwards from the outlet opening 104 and leads into the connecting duct 78.

In FIG. 5 the control valve 24 is in the open position. In this case the control valve member 58 is acted upon by a force, which is directed toward the actuator 22, as indicated by the thick arrow, and which is equal to the pressure differential between the pressure of the fuel in the control valve chamber 56, connected to the control pressure inlet 26, and in the relief groove 108 connected to the low-pressure outlet 54, multiplied by the difference between the area of the compensating piston 112—diameter D2—and the area of the sealing shoulder 106—diameter D1. In order to close the control valve 104, the actuator 48 must therefore apply a drive force in opposition to this force.

In FIG. 6 the control valve 24 is in the closed position, the control valve member 58 bearing on the control valve seat 66 and sealing off the inlet groove 68. In FIG. 6, D3 denotes the diameter of the outlet opening 104. D4 indicates the diameter of the control valve member 58, and D5 denotes the diameter of the stem 62'. In the closed position of the control valve 24, a force acts on the control valve member 58 (in the opposite direction to the thick arrow), which is equal to the pressure differential between the pressure of the fuel in the inlet groove 68 connected to the control pressure inlet 26 and the pressure of the fuel in the control valve chamber 56 connected to the low-pressure outlet 54, multiplied by the annular area having an outside diameter of D4 and an inside diameter of D3. This force is at least partially compensated for by the force generated by the compensating piston 112, which is equal to the pressure differential of the fuel in the compensating pressure chamber 116 connected to the high-pressure inlet 26 and the compensating low-pressure chamber 118 connected to the low-pressure outlet 54, multiplied by the hydraulically active area of the compensating piston 112. This is given by the difference between the cross-sectional area of the compensating piston 112—diameter D2 in FIG. 5—and the cross section of the stem 62'—diameter D5—in FIG. 6. With the control valve in the closed position, therefore, the actuator 22 has to apply a reduced force acting in the direction of the thick arrow. Depending on the selected dimensions of the diameters D1, D2, D3, D4 and D5, the hydraulic forces acting on the control valve 58 in its open and/or closed position can be designed for optimum functioning of the actuator 22.

FIG. 7 shows a further embodiment of the injection valve according to the invention, which with regard to the control valve 24 is of identical design to that in FIG. 4. The C-shaped connecting duct, however, does not open directly into the piston drive chamber 76, but into the further connecting duct 78' arranged concentrically with the axis 16.

In contrast to the embodiment according to FIG. 4, the control pressure-side piston part 28' of the booster piston 28 is of stepped design. On its side facing the piston drive chamber 76, it has a circular cylindrical piston projection 122 concentric with the axis 16, the diameter of which labeled Da is somewhat greater than the diameter of the high-pressure side piston part 28" labeled Db.

Accordingly, the piston guide chamber 74 has an extension 124, into which the piston projection 122 is plunged by the length L when the booster piston 28 is in the rest position shown in FIG. 7. In this position the stop lugs 80 bear on the bottom of the extension 124.

When the control valve 24 opens only the piston projection 122 is initially subjected to the control pressure. At first, therefore, the pressure gain is slight, since the diameter Da is smaller than the diameter of the piston part 28'. However, once the booster piston 28 has moved by the stroke length L toward the piston output chamber 84 (cf. FIG. 1), the entire piston part 28' is subjected to the control pressure, producing the full pressure gain.

It is also possible, as indicated by dashed lines in FIG. 7, to form connecting grooves 126 on the piston projection 122, distributed around the periphery and increasing in cross section toward the free end of the piston projection 122. The transition from a low pressure gain to the full pressure gain can thereby be made continuous. A restriction passage between the extension 124 and the drive chamber 76 would have a similar effect (not shown in FIG. 7).

FIGS. 8 and 9 show an embodiment with pressure compensation, which is very similar to the embodiment shown in FIGS. 5 and 6. The design construction is shown in more detail, however.

A pellet-like control valve seat body 130 is inserted in a stepped housing recess 128 concentric with the axis 16 and adjoining the recess 18. With the one end face said body bears tightly on the bottom of the housing recess 128 and the control valve seat 66, the inlet groove 68 and the outlet opening 104 are formed at the other end face. A bore passing through the control valve seat body 130 parallel to the axis 16 forms a part of the connecting duct 78, which at the bottom of the housing recess 128 is flow-connected to a further part of the connecting duct 78 formed on the housing 10 and leading to the piston drive chamber 76.

The annular duct 68' feeding the inlet groove 68 with fuel extends from the bottom end face of the control valve body 130 to the inlet groove 68, the annular duct 68', however, in the half of the control valve seat body 130 facing the inlet groove 68, being subdivided by three peripherally spaced webs 132. These webs 132 connect the part of the control valve seat body 130 situated radially inwards of the annular duct 68' to the radially outer part; see FIG. 9, in particular. In one of these webs 132, an inclined bore forming the further connecting duct 78' runs from the outlet opening 104 to the connecting duct 78. The compensating low-pressure passage 120 runs through another web 132. This passage opens out of the cylinder recess 114, which is recessed into the control valve seat body 130 in the manner of a blind hole and at the other side is closed by the bottom of the housing recess 128.

The hollow cylindrical compensating piston 112, which is firmly seated on the nearside end area of the stem 62', integrally formed with the operating stem 62, is accommodated in a tight sliding fit in the cylinder recess 114. The compensating pressure chamber 116 is connected by way of a radially running passage to the annular duct 68', which is in turn flow-connected at the bottom of the housing recess 128 to the control pressure duct 70 recessed into the housing 10.

Two positioning pins 134, which engage in corresponding blind holes in the bottom of the housing recess 128 in order to fix the rotational position of the control valve seat body 130 in relation to the housing 10, are furthermore let into the control valve seat body 130.

Seated on the end face of the control valve seat body 130 remote from the bottom of the housing recess 128 is a washer 136, which peripherally defines the control valve chamber 56 and the inside diameter of which is selected in such a way that the connecting duct 78 is flow-connected to the control valve chamber 56.

On the side remote from the control valve seat body 130, the control valve chamber 56 is defined by a disk 138, which rests on the washer 136 and is provided with a central bore 140, through which the operating stem 62 passes with some radial play. The annular gap between the operating stem 62 and the disk 138 forms the relief duct 64'. The disk-like control valve member 58 is seated on the operating stem 62 in the control valve chamber 56.

An annular screw 142 provided with a hexagon socket head, which with its external thread is screwed into an internal thread in the area of the housing recess 128, is arranged on the side of the disk 138 remote from the control valve chamber 56. This screw acts upon the disk 138, the washer 136 and the control valve seat body 130 with an axial force, so that these bear tightly on one another and the control valve seat body 130 bears tightly on the bottom of the housing recess 128.

The hexagon socket-head screw 142 internally defines a subspace in the housing recess 128, which adjoins the low-pressure chamber 50. The low-pressure passage 52 is formed by a radial bore in the housing 10.

The actuator housing 38, which together with the actuator 22 inserted therein defines the low-pressure chamber 50, is seated on the nearside end of the housing 10.

In the embodiment shown in FIGS. 8 and 9, the operating stem 62 is firmly connected to the actuator stem 48. In such an embodiment the compensating piston 112 may be designed in such a way that it fully compensates for the forces acting on the control valve member 58.

For the sake of completeness it should be mentioned that the disk 138 also forms the seat for the sealing shoulder 106 of the control valve member 58, in order to separate the control valve chamber 56 off from the low-pressure chamber 50 when the control valve 24 is open.

If a solenoid-operated actuator 22 is used, the disk 138 interacting with the control valve member 58 also forms the stop for the actuator or the armature thereof. It is also possible with this embodiment to set the stroke of the actuator 22 through selection of the thickness of the washer 136 and the axial dimension of the control valve member 58.

In the embodiments shown in FIGS. 4-9 the control valve 24 embodied as a flat seat valve acts as a 2/3-way valve.

The fuel injection valves shown in FIGS. 1-9 function as follows. Starting from the state shown in FIGS. 1 and 6, with closed control valve 24 and the injection valve member 34 bearing on the injection valve seat 32, fuel is injected by activating the actuator 22 in such a way that the actuator stem 48 moves away from the control valve seat 66. The control valve member 58 thereby also moves away from the control valve seat member 66 into the open position shown in FIGS. 2, 4, 5, 7 and 8, thereby admitting a control pressure to the piston drive chamber 76. This causes the booster piston 28 to move toward the piston output chamber 84, so that on this side the pressure of the fuel in the piston output chamber 84 is boosted in the high-pressure line 88 and in the high-pressure fuel chamber 30. The hydraulic force acting on the injection valve 34 thereby increases, so that it is lifted off from the injection valve member seat 32 against the force of the closing spring 96 and the force generated by the control pressure in the cylinder chamber 36. As a result, fuel is injected under the increased pressure generated by the booster piston 28, as opposed to the control pressure present at the control pressure inlet 26.

In order to terminate the injection sequence, the actuator 22 is activated in such a way that the actuator stem 48 moves toward the control valve seat 66, thereby closing the control valve 24. Since the control valve chamber 56 and hence the piston drive chamber 76 are connected to the low-pressure chamber 50 through the restriction duct 64 and/or the relief duct 64', the differential piston now moves in the opposite direction, with the result that the fuel pressure in the high-pressure fuel chamber 30 falls very rapidly and the injection valve member 34 moves toward the injection valve seat 32, thereby terminating the injection sequence. When a pressure equilibrium prevails between the control pressure inlet 26 and the piston output chamber 84, the non-return valve 92 opens and fuel continues to flow into the piston output chamber 84 until the booster piston 28 bears with its stop lug 80 against the housing 10. The fuel injection valve is now ready for another injection sequence. In multiple injections, the booster piston 28, in the brief intervals between individual injections, need not necessarily return, or need not return fully, to the end of the piston drive chamber 76.

A characteristic of flat seat valves, as outlined in the exemplary embodiments shown, is that they expose a very large flow cross section, even for a very small opening lift.

As already explained above, the fuel injection valve according to the invention is also suitable for multiple injections.

The invention claimed is:

1. A fuel injection valve for intermittent fuel injection into the combustion chamber of an internal combustion engine, having an injection valve seat adjoining a high-pressure fuel chamber, a needle-shaped injection valve member, which on the one hand interacts with the injection valve seat and on the other in the manner of a piston defines a cylinder chamber connected to a control pressure inlet for the fuel at least during the injection sequence, a booster piston acting as a differential piston, which on the control pressure side defines a piston drive chamber, which via a control valve, controlled by means of an electrically activated actuator, can be connected to and separated from the control pressure inlet, and which on the high-pressure side defines a piston output chamber connected to the high-pressure fuel chamber, wherein the control valve is embodied as a flat seat valve and a control valve member is of disk-like design and interacts with a control valve seat, in the area of which an at least approximately annular inlet groove, connected to the control pressure inlet, is arranged.

2. The fuel injection valve as claimed in claim 1, wherein the cylinder chamber is permanently connected to the control pressure inlet.

3. A fuel injection valve for intermittent fuel injection into the combustion chamber of an internal combustion engine, having an injection valve seat adjoining a high-pressure fuel chamber, a needle-shaped injection valve member, which on the one hand interacts with the injection valve seat and on the other in the manner of a piston defines a cylinder chamber connected to a control pressure inlet for the fuel at least during the injection sequence, a booster piston acting as a differential piston, which on the control pressure side defines a piston drive chamber, which via a control valve, controlled by means of an electrically activated actuator, can be connected to and separated from the control pressure inlet, and which on the high-pressure side defines a piston output chamber connected to the high-pressure fuel chamber, wherein the control valve is embodied as a flat seat valve and the control valve has a control valve member, which is arranged in a control valve chamber, which is connected to a low-pressure chamber, at least when the control valve is closed.

4. The fuel injection valve as claimed in claim 3, wherein the control valve member is of disk-like design and interacts with a control valve seat, in the area of which an at least approximately annular inlet groove, connected to the control pressure inlet, is arranged.

5. The fuel injection valve as claimed in claim 4, wherein an outlet opening connected to the piston drive chamber is arranged in the area of the control valve seat, concentrically with and at a distance from the inlet groove.

6. The fuel injection valve as claimed in claim 4, wherein the control valve member is arranged on an operating stem, guided in a sliding fit and interacting with the actuator.

7. The fuel injection valve as claimed in claim 4, wherein the control valve member is connected to a compensating piston defining a compensating pressure chamber connected to the control pressure inlet.

8. The fuel injection valve as claimed in claim 1, wherein the piston output chamber is connected via a non-return valve to the high-pressure inlet.

9. The fuel injection valve as claimed in claim 1, wherein the piston output chamber is connected via a non-return valve to an inlet for the fuel to be injected.

10. The fuel injection valve as claimed in claim 1, wherein the piston drive chamber is connected via a restriction passage to a low-pressure outlet.

11. The fuel injection valve as claimed in claim 1, wherein the piston drive chamber is connected via a passage to a low-pressure outlet, and the low-pressure outlet is preferably closed by the control valve member when the control valve is open.

12. The fuel injection valve as claimed in claim 1, wherein the booster piston is stepped on the control pressure side and the piston drive chamber is at least approximately defined by reciprocal stepping.

13. The fuel injection valve as claimed in claim 1, wherein the actuator is embodied as a piezoactuator.

14. The fuel injection valve as claimed in claim 1, wherein the control valve has a control valve seat formed on an end face of a control valve seat body, and a washer of selectable thickness is arranged between the actuator and the control valve seat body.

15. The fuel injection valve as claimed in claim 3, wherein the piston output chamber is connected via a non-return valve to the high-pressure inlet.

16. The fuel injection valve as claimed in claim 3, wherein the piston output chamber is connected via a non-return valve to an inlet for the fuel to be injected.

17. The fuel injection valve as claimed in claim 3, wherein the piston drive chamber is connected via a restriction passage to a low-pressure outlet.

18. The fuel injection valve as claimed in claim 3, wherein the booster piston is stepped on the control pressure side and the piston drive chamber is at least approximately defined by reciprocal stepping.

19. The fuel injection valve as claimed in claim 11, wherein the booster piston is stepped on the control pressure side and the piston drive chamber is at least approximately defined by reciprocal stepping.

20. The fuel injection valve as claimed in claim 3, wherein the actuator is embodied as a piezoactuator.

21. The fuel injection valve as claimed in claim 11, wherein the actuator is embodied as a piezoactuator.

* * * * *